US009728310B2

(12) United States Patent
Yue et al.

(10) Patent No.: US 9,728,310 B2
(45) Date of Patent: Aug. 8, 2017

(54) SHORT-PROCESS METHOD FOR PREPARING SINTERED NDFEB MAGNETS WITH HIGH MAGNETIC PROPERTIES RECYCLING FROM NDFEB SLUDGE

(71) Applicants: BEIJING UNIVERSITY OF TECHNOLOGY, Beijing (CN); ANHUI EARTH-PANDA ADVANCE MAGNETIC MATERIAL CO., LTD., Lujiang County (CN)

(72) Inventors: Ming Yue, Beijing (CN); Weiqiang Liu, Beijing (CN); Xiantao Li, Beijing (CN); Meng Li, Beijing (CN); Min Liu, Beijing (CN); Dongtao Zhang, Beijing (CN); Xiaowen Yin, Beijing (CN); Xiulian Huang, Lujiang County (CN); Jingwu Chen, Lujiang County (CN); Xiaofei Yi, Lujiang County (CN)

(73) Assignees: BEIJING UNIVERSITY OF TECHNOLOGY, Beijing (CN); ANHUI EARTH-PANDA ADVANCE MAGNETIC MATERIAL CO., LTD., Anhui Province (CN)

( * ) Notice: Subject to any disclaimer, the term of this patent is extended or adjusted under 35 U.S.C. 154(b) by 0 days.

(21) Appl. No.: 15/133,042

(22) Filed: Apr. 19, 2016

(65) Prior Publication Data

US 2016/0260530 A1 Sep. 8, 2016

Related U.S. Application Data

(63) Continuation of application No. PCT/CN2015/077938, filed on Apr. 30, 2015.

(30) Foreign Application Priority Data

Mar. 8, 2015 (CN) ..... 2015 1 0101336

(51) Int. Cl.

| | |
|---|---|
| ***H01F 1/053*** | (2006.01) |
| ***C22C 38/60*** | (2006.01) |
| ***C22C 38/16*** | (2006.01) |
| ***C22C 38/14*** | (2006.01) |
| ***C22C 38/12*** | (2006.01) |
| ***C22C 38/10*** | (2006.01) |
| ***C22C 38/06*** | (2006.01) |

(Continued)

(52) U.S. Cl.

CPC ..... *H01F 1/0536* (2013.01); *B22F 1/0003* (2013.01); *B22F 3/087* (2013.01); *B22F 3/10* (2013.01); *B22F 3/16* (2013.01); *B22F 5/00* (2013.01); *B22F 9/04* (2013.01); *B22F 9/30* (2013.01); *C21B 15/00* (2013.01); *C22C 33/0235* (2013.01); *C22C 33/0264* (2013.01); *C22C 38/002* (2013.01); *C22C 38/005* (2013.01); *C22C 38/008* (2013.01); *C22C 38/06* (2013.01); *C22C 38/10* (2013.01); *C22C 38/12* (2013.01); *C22C 38/14* (2013.01); *C22C 38/16* (2013.01); *C22C 38/60* (2013.01); *H01F 41/0266* (2013.01); *B22F 2301/355* (2013.01); *B22F 2303/01* (2013.01); *B22F 2303/15* (2013.01); *B22F 2303/45* (2013.01); *B22F 2304/10* (2013.01); *B22F 2998/10* (2013.01)

(58) Field of Classification Search

CPC ..... H01F 1/053; C22C 38/16; C22C 33/02; B22F 3/16; C22B 59/00

See application file for complete search history.

(56) References Cited

U.S. PATENT DOCUMENTS 3,748,193 A * 7/1973 Cech ..... H01F 1/0553 148/100
3,878,000 A * 4/1975 McFarland ..... H01F 1/06 148/105

(Continued)

FOREIGN PATENT DOCUMENTS

CN 102211192 A 10/2011
CN 103117143 A 5/2013

(Continued)

OTHER PUBLICATIONS

International Search Report of corresponding International PCT Application No. PCT/CN2015/077938, dated Dec. 1, 2015.

*Primary Examiner* — Jonathan Johnson
*Assistant Examiner* — Christopher Kessler
(74) *Attorney, Agent, or Firm* — J.C. Patents

(57) ABSTRACT

The present invention discloses a short process preparation technology of sintered NdFeB magnets from the NdFeB sludge, which relates to a field of recycle technology of NdFeB sludge. The present invention comprises the following steps: water bath distillation of organics in sludge, ultrasonic cleaning, calcium reduction and diffusion, ultrasonic rinsing in a magnetic field and drying, powders mixing and sintering. NdFeB sludge as raw materials was directly prepared from recycled sintered magnets with high magnetic properties. Most of the organics in the sludge could be removed by a vacuum distillation process with stepwise heating. The ultrasonic rinsing process in a magnetic field could effectively remove the remaining organics. The recycled sintered magnets exhibited good maximum energy product [$(BH)_{max}$] of 35.26 MGOe. The present invention has important features, such as the short processing time, efficient environmental protection, high recycling rate and effective utilization rate of rare earth metals.

8 Claims, 3 Drawing Sheets

(51) Int. Cl.

| | |
|---|---|
| ***C22C 38/00*** | (2006.01) |
| ***C22C 33/02*** | (2006.01) |
| ***B22F 1/00*** | (2006.01) |
| ***B22F 3/087*** | (2006.01) |
| ***B22F 3/10*** | (2006.01) |
| ***B22F 3/16*** | (2006.01) |
| ***B22F 5/00*** | (2006.01) |
| ***B22F 9/04*** | (2006.01) |
| ***B22F 9/30*** | (2006.01) |
| ***C21B 15/00*** | (2006.01) |
| ***H01F 41/02*** | (2006.01) |

(56) References Cited

U.S. PATENT DOCUMENTS

| | | | | |
|---|---|---|---|---|
| 4,894,097 | A | 1/1990 | Iijima et al. | 148/101 |
| 5,091,020 | A * | 2/1992 | Kim | B22F 9/023 148/101 |
| 2014/0369881 | A1 * | 12/2014 | Zakotnik | B23P 19/04 419/26 |

FOREIGN PATENT DOCUMENTS

| | | | |
|---|---|---|---|
| CN | 103882234 | A | 6/2014 |
| CN | 104036949 | A | 9/2014 |
| JP | 2002-356724 | A | 12/2002 |

* cited by examiner

SHORT-PROCESS METHOD FOR PREPARING SINTERED NDFEB MAGNETS WITH HIGH MAGNETIC PROPERTIES RECYCLING FROM NDFEB SLUDGE

CROSS REFERENCE TO RELATED APPLICATION

This application is a continuation application of international application No. PCT/CN2015/077938, filed on Apr. 30, 2015, and titled "Short-Process Method for Preparing Sintered NdFeB Magnets with High Magnetic Properties Recycling from NdFeB Sludge", which in turn claims the priority benefit of Chinese Patent Application No. 201510101336.1, filed on Mar. 8, 2015, the contents of the above identified applications are hereby incorporated by reference in its entirety.

TECHNICAL FIELD

This present disclosure relates to a recycling technology field of NdFeB sludge, and more particularly to short process preparation technology of sintered NdFeB magnets from NdFeB sludge.

BACKGROUND

Compared to other magnetic materials, NdFeB magnetic materials have excellent magnetic and mechanical properties. Therefore, they have been applied in many fields, such as electronic information, household appliances, medical treatment, aerospace, and especially in the new green energy fields of energy conservation vehicles and wind power. These wide application fields also bring the rapid increase in annual output of NdFeB magnets. Consequently, the NdFeB wastes, including the scraps and sludge that are generated during the manufacture processes, are about 30 wt. % of the as-sintered materials. China, for example, as the largest manufacturer of NdFeB magnets, had an annual output of about 94 thousand tons in 2013, which accounted for 91% of the global output. At the same time, about 20-30 thousand tons of NdFeB raw materials were formed into sludge during the production process. With the development of global environmental legislation, as well as the requirement of resources protection and sustainable development, the recycling of waste NdFeB materials has become very important. As the price of rare-earth metals and the fabrication costs have increased over the years, the green and efficient recycling of waste NdFeB materials could not only protect the environment and save resources, but also bring substantial economic and social benefits.

At the present time, possible routes to recycle scraps of sintered NdFeB magnets are: (1) Hydrogen decrepitation to get powders, followed by coating with rare earth rich powders, alignment, and bonding or hot pressing into bulk magnets; (2) Hydrogenation, disproportionation, desorption, recombination (HDDR) process to obtain high coercivity powders for bonding or hot pressing; (3) Milling, alignment, and vacuum sintering into bulk magnets; (4) The powders could be blended with other fresh powders and processed by one of the ways above, but the magnetic properties would drop accordingly.

On the other hand, the recycle technology of NdFeB rare earth permanent magnet sludge waste is currently a hydrometallurgical process. These processes are comprised of the following: acid dissolution-precipitation process, complex salt conversion process, hydrochloric acid dissolved superior process, and full extraction processes. Various methods are briefly compared as follows: (1) Acid dissolution-precipitation process: This process belongs to relatively primitive methods. Main procedures include oxidizing roasting, acid decomposition, precipitation, burning to achieve rare earth oxides, subsequently electrolyzing rare earth fluoride to prepare pure metal. The recovery rate of rare earth oxides in batch production is low. (2) Hydrochloric acid dissolved superior process: This process is divided into oxide roasting, decomposition and purification, extraction and separation, and sedimentation burning. The recovery rate of rare earth is more than 95%, the purity of $Dy_2O_3$ is 99%, and the purity of $Pr_2O_3$ is 98% by this method. Furthermore, the raffinate can achieve precipitate of rare earth carbonate polymorphs which can meet customers' demands. (3) Sulfuric acid complex salt precipitation process: This process typically includes the following steps: sulfuric acid dissolution, complex salt precipitation of rare earths, alkali conversion, hydrochloric acid dissolution, extraction and separation, precipitation, and burning to obtain rare earth oxides. Complex salt conversion process could separate $Nd_2O_3$ and non-rare earth (Fe, Al, etc.). By this method, the purity of rare earth oxides could reach 93%. The recovery rate of $Nd_2O_3$ in final product is high (up to 85.53%), and the purity of $Nd_2O_3$ and $Dy_2O_3$ is 99%. Therefore, this process is widely used in the industry nowadays. (4) Full extraction process. Full solvent extraction processes of NdFeB waste are: extraction of iron by $N_{503}$, extraction of rare earth by $P_{507}$, separation of neodymium and dysprosium, further purification of cobalt. After 60 levels segment extraction test, $Nd_2O_3$ with 99% purity, $Dy_2O_3$ with 98% purity, and cobalt carbonate product with 99% purity are achieved. However, this process needs more steps and a longer production cycle. The final products of above process are rare earth oxide or metal, and the above-mentioned processes have common disadvantages of long flow, generation of a large amount of waste acid that pollutes the environment.

To solve these problems, China patent (Application No. 201410101544.7) disclosed a method for preparing the recycled NdFeB magnetic powders form NdFeB sludge. By this method, NdFeB powders could be obtained from the NdFeB sludge, but the resultant magnetic powders did not have the desired magnetic properties and cannot be directly used in applications.

DISCLOSURE OF THE INVENTION

The present invention overcomes the disadvantages in the existing technology and fabricates sintered NdFeB magnets with good magnetic properties by optimizing and adjusting the process. Waste NdFeB sludge was chosen as the raw materials. After the organic impurities were removed by distillation and ultrasonic cleaning, the recycled NdFeB powders were prepared by calcium reduction-diffusion reaction followed by rinsing. During the rinsing process, calcium oxide and non-magnetic materials were effectively separated by ultrasonic treatment in a magnetic field. The reduction process can also be improved by using $CaH_2$. Doping with $Nd_2O_3$ powders was beneficial in obtaining NdFeB powders with high performance. The recycled NdFeB powders with particle sizes of about 10 μm could significantly reduce energy consumption during the ball milling powders. The maximum magnetic energy product of recycled sintered NdFeB magnets by rare earth hydride nanoparticles doping was 35.26 MGOe, similar to those of current sintered NdFeB products. The invention has innovations of short process (NdFeB sludge as raw materials is directly fabricated into NdFeB powders and sintered magnets), high efficiency (the recycled magnets have good magnetic properties), environmental protection (preparation process does not produce waste acid, waste liquid and waste gas).

The present invention comprises the following steps: water bath distillation of sludge, ultrasonic cleaning, calcium reduction and diffusion, ultrasonic rinsing in the magnetic field, drying, powders mixing and sintering:

(1) Water bath distillation of sludge: Distilled water was added into the sludge with an optimized volume ratio of 1:15 between sludge and distilled water and stirred. Subsequently, water bath distillation with stepwise increasing temperature in vacuum was carried out to obtain the powders. The optimized procedure started from 30° C. to 80° C. with increments of 5° C. in the intervals of 5-10 min until the internal liquid had evaporated. The operation was repeated for 3 times.

(2) Ultrasonic cleaning for sludge: The distillation powders after the step (1) were washed for 3 times by acetone in an ultrasonic vessel, followed by ultrasonic cleaning in ethanol. After removal of the liquid, the wet powders were dried (e.g. under vacuum conditions at 50° C.) to obtain the pretreatment powders. The optimized ratio of powders, acetone and ethanol was 5 g, 10 ml and 10 ml, respectively.

(3) Calcium reduction-diffusion: The pretreatment powders after the step (2), with an appropriate amount of $Nd_2O_3$, FeB, and $CaH_2$ as the reactant, as well as CaO as a dispersant, were carried out using the calcium reduction diffusion reaction.

The pretreatment powders after step (2) were analyzed by x-ray fluorescence (XRF). Based on XRF results and calculation in accordance with $RE_2Fe_{14}B$ stoichiometric ratio, $Nd_2O_3$, FeB, $CaH_2$ and CaO powders should be added before reaction. $Nd_2O_3$ was added to make sure that the amount of rare earth was 40 wt. % of in mixed powders of pretreatment powders, $Nd_2O_3$, and FeB; FeB was added to make sure that the amount of B in mixed powders of pretreatment powders, $Nd_2O_3$, and FeB was in excess 0-10 wt. % of that in $RE_2Fe_{14}B$ compound (i.e., the amount of B in the mixed powders of pretreatment powders, $Nd_2O_3$, and FeB was in excess 0-10 wt. % of that in $RE_2Fe_{14}B$ compound. For example, the weight percentage of B in $RE_2Fe_{14}B$ was x wt. %, the weight percentage of B in mixed powders of pretreatment powders, $Nd_2O_3$, and FeB was x−(x+10) wt. %); The quantity of $CaH_2$ was 1.2-1.3 times as large as in the mixed powders; The quantity of CaO was 50 wt. % of $CaH_2$. Reduction diffusion reaction was carried out in 1160-1240° C. for 60-150 min in inert gas.

(4) Rinsing and drying: The reducing product after the step (3) was grinded, ultrasonically rinsed in a glass container in a magnetic field, and then dried. The reducing product was preferably ultrasonically rinsed for 3 times with 15% glycerol aqueous solution in magnetic field of 0.1-0.5 T, then rinsed with water until the pH value of the supernatant reached 8-10, and finally was washed by ethanol and ether for 15 min, respectively. After rinsing, the product was dried in a vacuum of $10^{-3}$ Pa at 400° C. for 120 min to obtain the recycled NdFeB powders with particle sizes of about 10 μm. The optimized for each rinsing time was 15 min.

(5) Mixing powders and sintering: The resulting recycled NdFeB powders after the step (4) were milled to 3-5 μm, doped by rare earth hydride nanoparticles of 10-20 wt. %, and mixed; subsequently pressed and aligned in a magnetic field to get the green compact. The green compact was first dehydrogenated at 900-1000° C. for 30-180 min, and then sintered at 1050-1150° C. for 120-240 min, finally annealed at 850-950° C. for 60-180 min and 450-550° C. for 60-180 min, respectively. Thus the recycled sintered magnets were obtained.

The above-mentioned hydrides in step (5) were hydrogenated neodymium, hydrogenated praseodymium, hydrogenated dysprosium, or hydrogenated terbium.

The present invention chose NdFeB sludge as raw materials, and realized the recycling of NdFeB sludge. The preparation process did not produce waste acid, waste liquid and waste gas. The efficient and environmentally friendly process was short, therefore significantly reducing the fabrication cost of NdFeB magnets. The pretreatment sludge was directly prepared into NdFeB powders. The process took advantage of all valuable elements in the NdFeB sludge, and avoided the secondary waste during the recycling of sludge. After removing the calcium oxide by using magnetic ultrasonic rinse, the obtained NdFeB powders with particle sizes of about 10 μm facilitated the subsequent processing, which significantly reduced the energy consumption during the ball milling process. The recycled sintered magnets exhibited good maximum energy product [$(BH)_{max}$] of 35.26 MGOe.

DETAILED DESCRIPTION OF THE PREFERRED EMBODIMENTS

The following examples describe this disclosure, but do not limit the coverage of the disclosure.

EXAMPLE 1

Figure 1:
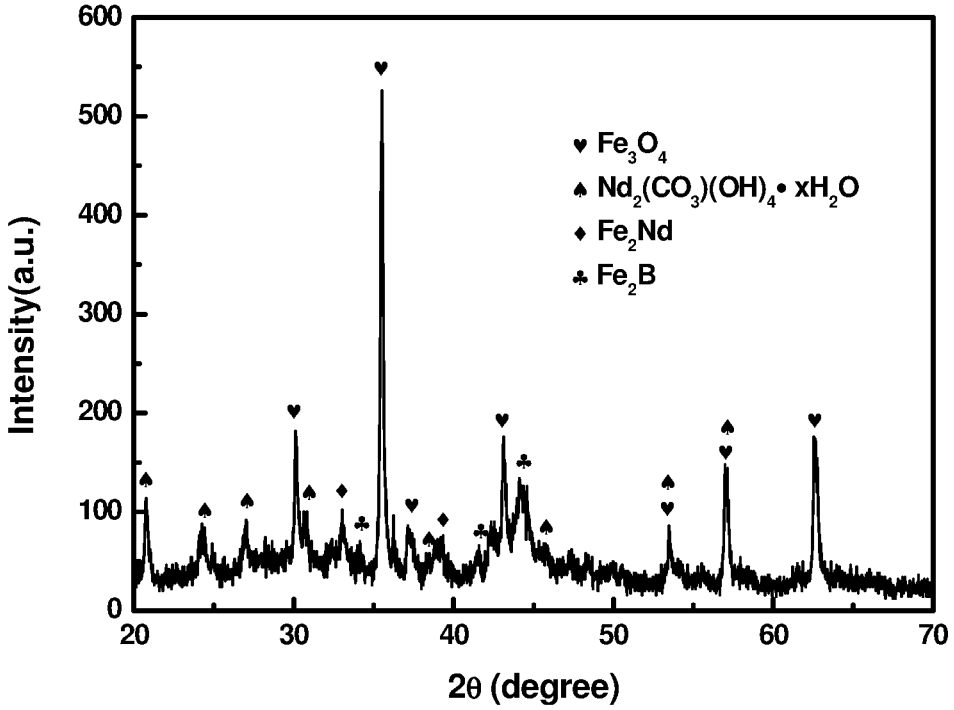
FIG. 1 shows the x-ray diffraction (XRD) pattern of the pretreatment sludge powders.

A NdFeB sludge of 30 ml with distilled water of 450 ml in a flask was distilled by rotary evaporator placed in a water bath under vacuum conditions. The procedure started from 30° C. to 80° C. with increments of 5° C. in the intervals of 5 min until the internal liquid had evaporated. The operation was repeated for 3 times. As a result, 26.42 g of distilled powders were obtained. The distillation powders were washed for 3 times by 52 ml of acetone in an ultrasonic vessel, and then were cleaned twice by ethanol in the ultrasonic vessel for 10 min. After removing the liquid, the wet powders were dried in vacuum at 50° C. to obtain the pretreatment powders. The XRD pattern and XRF results of the pretreatment powders are shown in FIG. 1 and TAB. 1, respectively. It was concluded that the pretreatment powders were mainly composed of $Fe_3O_4$, $Nd(CO_3)(OH)_4.xH_2O$, $Fe_2Nd$ and $Fe_2B$.

Figure 2:
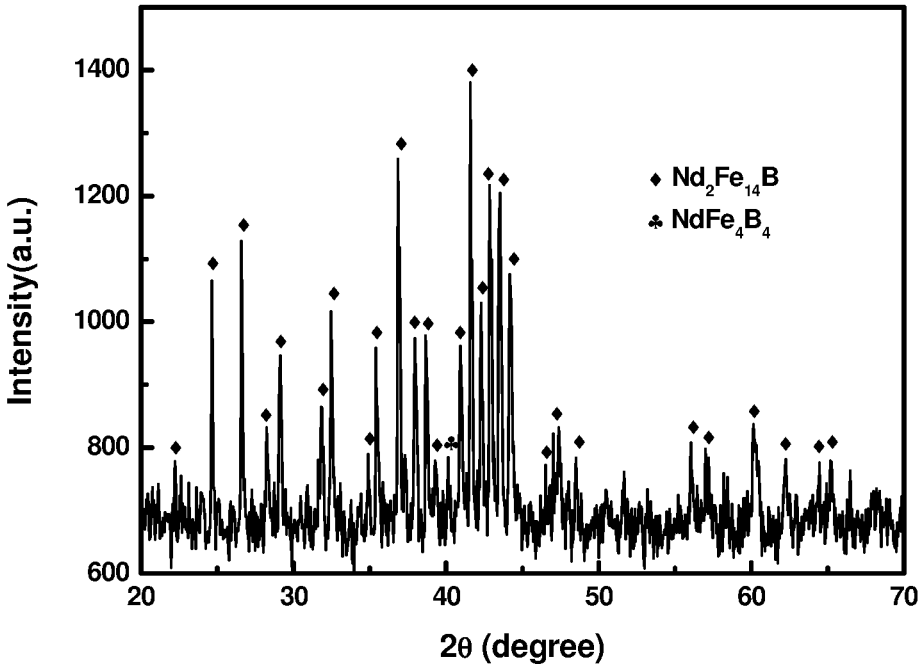
FIG. 2 shows the XRD pattern of the recycled NdFeB powders.
Figure 3:
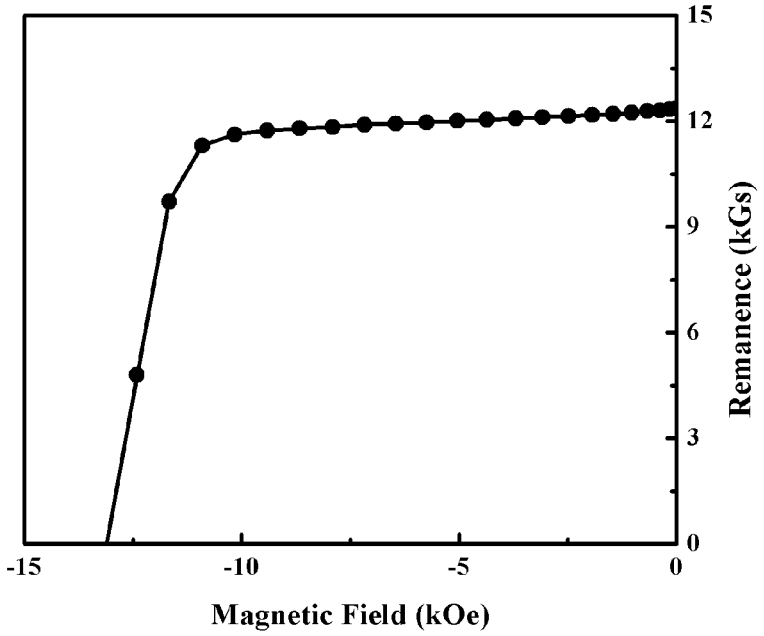
FIG. 3 shows the demagnetization curve of the recycled sintered NdFeB magnets.

Based on the elemental content, shown in TAB. 1, and calculations in accordance with $RE_2Fe_{14}B$ stoichiometric ratio, $Nd_2O_3$ was added to make sure that the amount of rare earth was 40 wt. % of mixed powders including pretreatment powders, $Nd_2O_3$ and FeB; FeB was added to make sure that the amount of B in the mixed powders was same as that in the $RE_2Fe_{14}B$ compound; The quantity of $CaH_2$ was 1.2 times as large as the mixed powders; The quantity of CaO was 50 wt. % of $CaH_2$. The mixed powders were grinded homogeneously, wrapped in tantalum foil, and placed in a tube furnace. Reduction diffusion reaction was carried out at 1160° C. for 150 min in inert gas. After cooling to room temperature, the reducing product was grinded, ultrasonically rinsed for 3 times with 15% glycerol aqueous solution in a magnetic field of 0.5 T, then rinsed with water until the pH value of the supernatant reached 9.3, and finally was washed by ethanol and ether for 15 min, respectively. After rinsing, the product was dried in vacuum of $10^{-3}$ Pa at 400° C. for 120 min to obtain the recycled NdFeB powders with particle sizes of about 10 μm. The XRD patterns of the recycled NdFeB powders are shown in FIG. 2. The recycled NdFeB powders were mainly composed of $Nd_2Fe_{14}B$ and a small amount of $NdFe_4B_4$ phase. The resulting recycled NdFeB powders were milled to about 5 μm, doped by hydrogenated neodymium nanoparticles of 15 wt. %, and mixed evenly; subsequently pressed and aligned in a magnetic field to obtain the compact. The green compact was first dehydrogenated at 900° C. for 120 min, and then sintered at 1100° C. for 180 min, finally annealed at 900° C. for 180 min and 480° C. for 120 min, respectively. The recycled sintered magnets exhibited good magnetic properties with the remanence ($B_r$) of 12.36 kGs, the coercivity ($H_{ci}$) of 13.12 kOe, and maximum energy product [$(BH)_{max}$] of 35.26 MGOe, as shown in FIG. 3.

EXAMPLE 2

A NdFeB sludge of 30 ml with distilled water of 450 ml in a flask was distilled by rotary evaporator placed in a water bath under vacuum conditions. The procedure started from 30° C. to 80° C. with increments of 5° C. in intervals of 8 min until the internal liquid had evaporated. The operation was repeated for 2 times. As a result, 25.64 g of distilled powders were obtained. The distillation powders were washed for 3 times by 51 ml of acetone in an ultrasonic vessel, and then were cleaned for 1 time by ethanol in the ultrasonic vessel for 12 min. After removing the liquid, the wet powders were dried in vacuum at 50° C. to obtain the pretreatment powders. The XRF results of the pretreatment powders are shown in TAB. 2.

Based on the elemental content, shown in TAB. 2, and calculations in accordance with $RE_2Fe_{14}B$ stoichiometric ratio, $Nd_2O_3$ was added to make sure that the amount of rare earth was 40 wt. % of mixed powders including the pretreatment powders, $Nd_2O_3$ and FeB; FeB was added to make sure that the amount of B in mixed powders was in excess of 5 wt. % of that in the $RE_2Fe_{14}B$ compound; The quantity of $CaH_2$ was 1.25 times as large as the mixed powders; The quantity of CaO was 50 wt. % of $CaH_2$. The mixed powders were grinded homogeneously, wrapped in tantalum foil, and placed in a tube furnace. Reduction diffusion reaction was carried out at 1180° C. for 110 min in inert gas. After cooling to room temperature, the reducing product was grinded, ultrasonically rinsed for 3 times with 15% glycerol aqueous solution in a magnetic field of 0.3 T, then rinsed with water until the pH value of the supernatant reached 10, and finally was washed by ethanol and ether for 15 min, respectively. After rinsing, the product was dried in vacuum of $10^{-3}$ Pa at 400° C. for 120 min to obtain the recycled NdFeB powders with particle sizes of about 10 μm. The resulting recycled NdFeB powders were milled down to about 3 μm, doped by hydrogenated praseodymium nanoparticles of 10 wt. %, and mixed evenly; subsequently pressed and aligned in a magnetic field to obtain the compact. The green compact was first dehydrogenated at 950° C. for 100 min, and then sintered at 1050° C. for 240 min, finally annealed at 850° C. for 120 min and 450° C. for 180 min, respectively. The recycled sintered magnets exhibited good magnetic properties with remanence ($B_r$) of 12.32 kGs, coercivity ($H_{ci}$) of 12.08 kOe, and maximum energy product [$(BH)_{max}$] of 35.45 MGOe.

EXAMPLE 3

A NdFeB sludge of 30 ml with distilled water of 450 ml in a flask was distilled by rotary evaporator placed in a water bath under vacuum conditions. The procedure started from 30° C. to 80° C. with increments of 5° C. in intervals of 10 min until the internal liquid had evaporated. The operation was repeated for 3 times. As a result, 25.26 g of distilled powders were obtained. The distillation powders were washed 3 times by 50.5 ml of acetone in an ultrasonic vessel, and then were cleaned for 2 times by ethanol in the ultrasonic vessel for 15 min. After removing the liquid, the wet powders were dried in vacuum at 50° C. to obtain the pretreatment powders. The XRF results of the pretreatment powders were shown in TAB. 3.

Based on the elemental content, shown in TAB. 3, and calculations in accordance with $RE_2Fe_{14}B$ stoichiometric ratio, $Nd_2O_3$ was added to make sure that the amount of rare earth was 40 wt. % of the mixed powders including the pretreatment powders, $Nd_2O_3$ and FeB; FeB was added to make sure that the amount of B in mixed powders was in excess of 8 wt. % of that in the $RE_2Fe_{14}B$ compound; The quantity of $CaH_2$ was 1.3 times as large as in the mixed powders; The quantity of CaO was 50 wt. % of $CaH_2$. The mixed powders were grinded homogeneously, wrapped in tantalum foil, and placed in a tube furnace. Reduction diffusion reaction was carried out at 1240° C. for 60 min in inert gas. After cooling to room temperature, the reducing product was grinded, ultrasonically rinsed for 3 times in a 15% glycerol aqueous solution in a magnetic field of 0.1 T, then rinsed with water until the pH value of supernatant reached 8, and finally was washed by ethanol and ether for 15 min, respectively. After rinsing, the product was dried in a vacuum of $10^{-3}$ Pa at 400° C. for 120 min to obtain the recycled NdFeB powders with particle sizes of about 10 μm. The resulting recycled NdFeB powders were milled down to 4 μm, doped by hydrogenated dysprosium nanoparticles of 20 wt. %, and mixed evenly; subsequently pressed and aligned in a magnetic field to obtain the compact. The green compact was first dehydrogenated at 1000° C. for 30 min, then sintered 1150° C. for 120 min, and finally annealed at 950° C. for 60 min and 550° C. for 60 min, respectively. The recycled sintered magnets exhibited good magnetic properties with remanence ($B_r$) of 11.15 kGs, coercivity ($H_{ci}$) of 18.36 kOe, and maximum energy product [$(BH)_{max}$] of 31.66 MGOe.

EXAMPLE 4

A NdFeB sludge of 30 ml with distilled water of 450 ml in a flask was distilled by rotary evaporator in water bath under vacuum conditions. The procedure started from 30° C. to 80° C. with increments of 5° C. in intervals of 10 min until the internal liquid had evaporated. The operation was repeated for 2 times. As a result, 25.64 g of distilled powders were obtained. The distilled powders were washed for 4 times by 51 ml of acetone in an ultrasonic vessel, and then cleaned for 2 times by ethanol in the ultrasonic vessel for 15 min. After removing the liquid, the wet powders were dried in vacuum at 50° C. to obtain the pretreatment powders. The XRF results of the pretreatment powders are shown in TAB. 4.

Based on the elemental content, shown in TAB. 4, and calculations in accordance with $RE_2Fe_{14}B$ stoichiometric ratio, $Nd_2O_3$ was added to make sure that the amount of rare earth was 40 wt. % of the mixed powders including the pretreatment powders, $Nd_2O_3$ and FeB; FeB was added to make sure that the amount of B in mixed powders was in excess of 10 wt. % of that in the $RE_2Fe_{14}B$ compound; The quantity of $CaH_2$ was 1.2 times as large as the mixed powders; The quantity of CaO was 50 wt. % of $CaH_2$. The mixed powders were grinded homogeneously, wrapped in tantalum foil, and placed in a tube furnace. Reduction diffusion reaction was carried out at 1200° C. for 100 min in inert gas. After cooling to room temperature, the reducing product was grinded, ultrasonically rinsed for 3 times with 15% glycerol aqueous solution in a magnetic field of 0.1 T, then rinsed with water until the pH value of supernatant reached 9, and finally was washed by ethanol and ether for 15 min, respectively. After rinsing, the product was dried in a vacuum of $10^{-3}$ Pa at 400° C. for 120 min to obtain the recycled NdFeB powders with particle sizes of about 10 μm. The resulting recycled NdFeB powders were milled down to 4 μm, doped by hydrogenated terbium nanoparticles of 10 wt. %, and mixed evenly; subsequently pressed and aligned in a magnetic field to get the compact. The green compact was first dehydrogenated at 1000° C. for 60 min, and then sintered at 1100° C. for 180 min, and finally annealed at 900° C. for 180 min and 480° C. for 120 min, respectively. The recycled sintered magnets exhibited good magnetic properties with remanence ($B_r$) of 11.68 kGs, coercivity ($H_{ci}$) of 20.65 kOe, and maximum energy product [$(BH)_{max}$] of 32.25 MGOe.

TABLE 1

XRF results of the pretreatment powders (Example 1)

| Element | Content (wt. %) |
|---|---|
| Fe | 67.3135 |
| Nd | 20.6406 |
| Pr | 6.4564 |
| Dy | 2.5889 |
| Co | 1.1343 |
| Na | 0.3221 |
| Ho | 0.2905 |
| Cu | 0.2837 |
| Al | 0.2339 |
| Si | 0.2044 |
| Nb | 0.1916 |
| Ga | 0.1667 |
| S | 0.0656 |
| Zr | 0.0531 |
| Ca | 0.053 |
| W | 0.0018 |

TABLE 2

XRF results of the pretreatment powders (Example 2)

| Element | Content (wt. %) |
|---|---|
| Fe | 67.7794 |
| Nd | 20.5665 |
| Pr | 6.5391 |
| Dy | 2.4912 |
| Co | 1.1563 |
| Cu | 0.3022 |
| Ho | 0.2975 |
| Al | 0.2209 |
| Nb | 0.1953 |
| Ga | 0.1781 |
| Si | 0.1389 |

TABLE 2-continued

XRF results of the pretreatment powders (Example 2)

| Element | Content (wt. %) |
|---|---|
| Ca | 0.0609 |
| Zr | 0.0441 |
| S | 0.0296 |

TABLE 3

XRF results of the pretreatment powders (Example 3)

| Element | Content (wt. %) |
|---|---|
| Fe | 66.9291 |
| Nd | 20.6427 |
| Pr | 6.5183 |
| Dy | 2.4626 |
| Co | 1.1642 |
| Tb | 0.7997 |
| Ho | 0.2820 |
| Cu | 0.2702 |
| Al | 0.2381 |
| Si | 0.2093 |
| Nb | 0.1873 |
| Ga | 0.1598 |
| Ca | 0.0567 |
| Zr | 0.0544 |
| S | 0.0256 |

TABLE 4

XRF results of the pretreatment powders (Example 4)

| Element | Content (wt. %) |
|---|---|
| Fe | 66.3840 |
| Nd | 20.9083 |
| Pr | 6.6052 |
| Dy | 2.5265 |
| Co | 1.1398 |
| Tb | 0.8582 |
| Cu | 0.3107 |
| Ho | 0.2898 |
| Si | 0.2554 |
| Al | 0.2425 |
| Nb | 0.1867 |
| Ga | 0.1781 |
| Ca | 0.0611 |
| Zr | 0.0538 |

What is claimed is:

1. A short-process method for preparing sintered NdFeB magnets from NdFeB sludge, comprising the following steps: water bath distillation of sludge, ultrasonic cleaning, calcium reduction and diffusion, ultrasonic rinsing in a magnetic field, drying, powders mixing and sintering:

(1) water bath distillation of sludge: wherein distilled water is added into the sludge and stirred, subsequently, water bath distillation with stepwise temperature increase is carried out under vacuum until internal liquid has evaporated, the operation is repeated to obtain distillation powders;

(2) ultrasonic cleaning for sludge: wherein the distillation powders of step (1) are washed by acetone in an ultrasonic vessel, followed by cleaning by ethanol in the ultrasonic vessel, after removing liquid, wet powders are dried to get pretreatment powders;

(3) calcium reduction-diffusion: wherein the pretreatment powders of step (2) is added with appropriate amounts of $Nd_2O_3$ and FeB, and calcium reduction diffusion reaction is conducted using $CaH_2$ as reactant and CaO as dispersant;

(4) rinsing and drying: wherein reducing product of step (3) is grinded, ultrasonically rinsed in a glass container in a magnetic field, and then dried;

(5) mixing powders and sintering: wherein resulting recycled NdFeB powders of step (4) are milled down to 3-5 pm, doped by rare earth hydride nanoparticles of 10-20 wt. %, and mixed; subsequently pressed and aligned in a magnetic field to obtain a green compact; the green compact is first dehydrogenated at 900-1000° C. for 30-180 min, and then sintered at 1050-1150° C. for 120-240 min, and finally annealed at 850-950° C. for 60-180 min and 450-550° C. for 60-180 min, respectively; so as to obtain recycled sintered magnets.

2. The short-process method for preparingsintered NdFeB magnets from NdFeB sludge according to claim 1, wherein in step (1) the volume ratio between the sludge and the distilled water is 1:15, water bath distillation is carried out under vacuum with stepwise temperature increase, preferably starting from 30° C. and increased to 80° C. with increments of 5° C. in intervals of 5-10 min until the internal liquid has evaporated, the operation is repeated to obtain the distillation powders.

3. The short-process method for preparing sintered NdFeB magnets from NdFeB sludge according to claim 1, wherein in step (2) every 5 g of the distillation powders corresponds to 10 ml acetone and 10 ml ethanol.

4. The short-process method for preparing sintered NdFeB magnets from NdFeB sludge according to claim 1, wherein the materials quality in the step (3) of calcium reduction-diffusion are: the pretreatment powders after step (2) are analyzed by XRF, based on XRF results and calculations in accordance with $RE_2Fe_{14}B$ stoichiometric ratio, $Nd_2O_3$ is added to make sure that the amount of rare earth was 40 wt. % of the mixed powders of the pretreatment powders, $Nd_2O_3$ and FeB; FeB is added to make sure that the amount of B in mixed powders of the pretreatment powders, $Nd_2O_3$ and FeB is in excess 0-10 wt. % of that in stoichiometric $RE_2Fe_{14}B$; the quantity of $CaH_2$ is 1.2-1.3 times as large as the mixed powders; the quantity of CaO is 50 wt. % of $CaH_2$.

5. The short-process method for preparing sintered NdFeB magnets from NdFeB sludge according to claim 1, wherein in step (3) the reduction diffusion reaction is carried out at 1160-1240° C. for 60-150 min in inert gas.

6. The short-process method for preparing sintered NdFeB magnets from NdFeB sludge according to claim 1, wherein the reducing product is ultrasonically rinsed with glycerol aqueous solution in a magnetic field of 0.1-0.5 T and, then rinsed with water until the pH value of supernatant reaches 8-10, and finally is washed by ethanol and ether, respectively, after rinsing, the product is dried in vacuum to obtain recycled NdFeB powders.

7. The short-process method for preparing sintered NdFeB magnets from NdFeB sludge according to claim 6, wherein an optimized rinsing time is 15 min.

8. The short-process method for preparing sintered NdFeB magnets from NdFeB sludge according to claim 1, wherein the rare earth hydride nanoparticles are made of hydrogenated neodymium, hydrogenated praseodymium, hydrogenated dysprosium, or hydrogenated terbium.

* * * * *